US005915688A

United States Patent [19]

Klenk et al.

[11] Patent Number: 5,915,688

[45] Date of Patent: Jun. 29, 1999

[54] DEVICE FOR FORMING AN AUXILIARY SHEET PILE DURING A NONSTOP PILE CHANGE IN A DELIVERY OF A PRINTING PRESS

[75] Inventors: Rainer Klenk, St. Leon Rot; Richard Mack, Brühl; Gerd Raasch, Sandhausen, all of Germany

[73] Assignee: Heidelberger Druckmaschinen AG, Heidelberg, Germany

[21] Appl. No.: 08/745,488

[22] Filed: Nov. 12, 1996

[30] Foreign Application Priority Data

Nov. 9, 1995 [DE] Germany ..... 195 41 792

[51] Int. Cl.[6] ..... B65H 31/12

[52] U.S. Cl. ..... 271/218

[58] Field of Search ..... 271/218

[56] References Cited

U.S. PATENT DOCUMENTS

| | | | |
|---|---|---|---|
| 4,796,879 | 1/1989 | Martini et al. | 271/218 |
| 5,131,647 | 7/1992 | Henn et al. . | |
| 5,407,189 | 4/1995 | Klenk | 271/218 |
| 5,433,429 | 7/1995 | Muller | 271/218 X |

FOREIGN PATENT DOCUMENTS

| | | |
|---|---|---|
| 0 316 568 | 5/1989 | European Pat. Off. . |
| 24 41 459 | 3/1976 | Germany . |
| 2 079 259 | 1/1982 | United Kingdom . |
| 2 157 272 | 10/1985 | United Kingdom . |
| 2 267 275 | 12/1993 | United Kingdom . |

*Primary Examiner*—Boris Milef

*Attorney, Agent, or Firm*—Herbert L. Lerner; Laurence A. Greenberg

[57] ABSTRACT

A device for automatically performing nonstop pile changing in a delivery of a printing press, preferably having a high printing speed, includes a separator sword movable sidewise between two sheets for forming a gap therebetween, and supporting an upper one of the two sheets at a trailing-edge region thereof until an auxiliary pile carrier has reached an inserted position thereof The separator sword cooperates with a restraining or holding device formed as a separator wedge, so that the separator wedge is slidable under the separator sword and firmly holds the upper sheet at the trailing-edge region thereof by suction until the auxiliary pile carrier has been inserted

20 Claims, 7 Drawing Sheets

1
2
3
3a
4
5
6
8
9
10
11
12
13
13
14
15

12
13
19
18
4
16
3
3a
1
2
7
6
17
15
13
11
13
14

DEVICE FOR FORMING AN AUXILIARY SHEET PILE DURING A NONSTOP PILE CHANGE IN A DELIVERY OF A PRINTING PRESS

BACKGROUND OF THE INVENTION

Field of the Invention

The invention relates to a device for forming an auxiliary sheet pile during a nonstop pile change in a delivery of a printing press, wherein an auxiliary pile carrier for temporarily receiving oncoming sheets is insertable in a sheet feeding direction between two sheets separated from one another at respective trailing edges thereof, and a separator sword briefly supports an upper one of the two sheets at the rear edge thereof over the entire width of the respective sheet, until the auxiliary pile carrier has reached an inserted position thereof.

Such construction features have become known heretofore from the published German Patent Document DE 12 31 721 C1. A lattice or grating mechanically insertable between two successively arriving sheets in the sheet feeding direction forms the auxiliary pile carrier or support in the heretofore known construction, whereon the sheets temporarily form an auxiliary pile, so that the main sheet pile can be removed and a new main sheet pile carrier or support can be brought into position. The pile change takes place while the press is running and during a printing run. At least in presses with relatively high printing speeds, it is necessary to reduce the press speed to change piles, in order to permit the insertion of the lattice or grating between two successively oncoming sheets. The pile changing sequence may occur automatically, if necessary or desirable. Other auxiliary pile carrier constructions which are suitable for mechanical insertion are disclosed, for example, in the published German Patent Documents DE 30 28 865 A1 or DE 42 21 928 A1.

Mechanically displaced auxiliary pile carriers in this or in modified constructions have heretofore not gained acceptance in high-speed presses, especially when thin paper grades are being processed thereby. The insertion and removal of the auxiliary pile carrier with the attendant damage to sheets of paper represent a major problem. Proposals do exist for reducing the friction between the auxiliary pile carrier and the lowermost sheet in the auxiliary pile, such as auxiliary pile carriers with roller elements or with a coating on the surface thereof which reduces friction, however, in high-speed presses and when thin printing stock is to be processed, a breakthrough has proved unachievable, so that the application of such provisions remains limited to printing presses for cardboard or pasteboard and the like.

From the published German Patent Document DE 42 178 16 A1, a device for continuous delivery of segments which have been cut from a web of printing material has become known heretofore, wherein a lowerable or downwardly movable auxiliary pile unit has both a remote-controlled auxiliary pile support, which is extensible horizontally inwardly and outwardly, and a remote-controlled separator belt, for separating the continuously arriving stream of segments in a defined manner into a main pile and an auxiliary pile. Particularly with thin materials, however, the upper segment resting on the separator belt may slip when the auxiliary pile support is inserted and may be damaged at the leading edge thereof.

SUMMARY OF THE INVENTION

It is accordingly an object of the invention is to provide a device for automatically forming an auxiliary sheet pile during a nonstop pile change in a delivery of a printing press, which is suitable in particular for sheet-fed printing presses with a high printing speed without reducing the speed, and which avoids damage to the delivered sheets.

With the foregoing and other objects in view, there is provided, in accordance with the invention, a device for forming an auxiliary sheet pile during a nonstop pile change in a delivery of a printing press, including an auxiliary pile carrier for temporarily receiving oncoming sheets, the auxiliary pile carrier being insertable in a sheet feeding direction between two sheets separated from one another at respective trailing edges thereof, and a separator sword briefly supporting an upper one of the two sheets at the rear edge thereof over the entire width of the respective sheet, until the auxiliary pile carrier has reached an inserted position thereof, comprising a restraining device for securing the upper sheet against displacement by the auxiliary pile carrier.

In accordance with another feature of the invention, the restraining device is a separator wedge movable in the sheet feeding direction and being subjectible to suction, the separator wedge having suction nozzles on a wedgelike top thereof and cooperating with the separator sword so that the separator wedge is slidable under the separator sword in the sheet feeding direction for firmly holding the upper sheet by suction in a trailing-edge region thereof, until the auxiliary pile carrier has been inserted.

In accordance with a further feature of the invention, the auxiliary pile forming device includes a carriage adjustably guidable in the sheet feeding direction, the separator sword being secured to a revolvingly drivable belt and supported therewith in the carriage.

In accordance with an added feature of the invention, the separator sword is formed by a widening of a flexible belt extending obliquely to the sheet feeding direction, the separator sword being coated with plastic material.

In accordance with an additional feature of the invention, the carriage is disposed adjustably with respect to sheet format for supporting the flexible belt with the separator sword formed thereon.

In accordance with yet another feature of the invention, the auxiliary pile forming device includes deflection rollers supported in the carriage for guiding the flexible belt with the separator sword formed thereon parallel to the plane of the sheets under the oncoming sheets in a region of maximum sheet width.

In accordance with yet a further feature of the invention, the deflection rollers for guiding the revolvingly drivable flexible belt formed with the separator sword are formed with respective guiding grooves on the circumferences thereof, the flexible belt being formed with one of a beveled edge and a bead and being engageable therewith in the guiding grooves.

In accordance with yet an added feature of the invention, the auxiliary pile forming device includes a crossbar extending over the sheet width, the flexible belt being guidable at a trailing edge thereof, as viewed in the sheet feeding direction, parallel to the plane of the sheets, in the crossbar.

In accordance with yet an additional feature of the invention, the separator wedge is formed with a cross section parallel to the sheet feeding direction which has a flat boxlike profile, the boxlike profile being beveled in the sheet feeding direction at a front top side thereof, and auxiliary pile forming device includes suction nozzles located in the beveled region and being connected via the interior of the boxlike profile to a source of suction.

In accordance with still another feature of the invention, the auxiliary pile forming device includes pneumatic piston-cylinder units for driving the separator sword and for driving the separator wedge.

In accordance with still a further feature of the invention, the auxiliary pile carrier is movable transversely to sheet travel into the gap formed by the separator sword between two sheets.

In accordance with still an added feature of the invention, the auxiliary pile forming device includes trailing-edge stops for the sheets in the sheet pile, the stops being disposed so as to be lowerable and pivotable, respectively.

In accordance with still an additional feature of the invention, the restraining device includes at least one gripper cooperating with the separator sword so that the gripper grasps the top sheet at a trailing-edge region thereof and firmly hold it until the auxiliary pile carrier has been inserted.

In accordance with another feature of the invention, the at least one gripper is movable in the sheet feeding direction.

In accordance with a further feature of the invention, the at least one gripper selectively grips the top sheet alone and together with other sheets resting thereon, respectively, and firmly holds that which is gripped.

In accordance with an added feature of the invention, the at least one gripper has open gripper jaws by which the gripper encloses one of the separator belt and the separator sword, and selectively clamps the top sheet alone and together with other sheets resting thereon, respectively, against one of the separator belt and the separator sword.

In accordance with an additional feature of the invention, at least one of the jaws of the at least one gripper is kept open by spring force and is formed with a chamfer cooperating with a stop so that the at least one gripper jaw closes upon running onto the stop.

In accordance with yet another feature of the invention, the flexible belt is a steel belt.

In accordance with yet a further feature of the invention, the plastic material is polytetrafluorethylene.

In accordance with a concomitant feature of the invention, the suction source is the suction system of the printing press.

The restraining or holding device which is provided protects the sheets resting on the separator belt against damage.

The separator sword is insertable between two sheets in the region of the trailing edge of the oncoming sheets, even at high printing speeds during which the sheets arrive very close together, and it effects the formation over the entire width of a sheet of a gap having a greater height than the spaced distance between the sheets, an auxiliary pile carrier of suitable construction being insertable into the gap with the restraining or holding device being activated. The separator sword then supports the top sheet only in the region of the trailing edge thereof, over the entire width of the sheet.

In one embodiment of the invention, the restraining device is a separator wedge, which can be acted upon by suction and which has suction nozzles on a wedgelike top thereof. This separator wedge cooperates with the separator sword so that the separator wedge, which is movable in the sheet feeding direction, slides under the separator sword, when the separator sword has been inserted in the trailing-edge region between two successively arriving sheets, and firmly holds the upper sheet by suction at the trailing-edge region until the auxiliary pile carrier has been inserted. This embodiment of the invention is particularly advantageous for thin papers.

In another embodiment, the restraining device includes one or more grippers which grasp and firmly hold the top sheet at the trailing edge thereof when the auxiliary pile carrier has been inserted.

With such a device according to the invention, auxiliary pile formation and, thus, automatic nonstop pile changing are realizable even at very high press speeds, without causing any damage to the sheets in the process.

Advantageously, the separator sword is formed on a belt, especially a steel belt, which is revolvably driven transversely to the sheet-feeding direction, the belt being supported in a carriage adjustably guided in the sheet-feeding direction, so that the separator sword can be adjusted to the sheet size or format.

On the steel belt, the separator sword can be formed by a widened portion extending obliquely to the sheet-feeding direction. As a result, the separator sword slides with a type of cutting motion between two successively oncoming sheets. Even at the smallest time intervals between two successively arriving sheets, the insertion of the separator sword is thereby made possible. The gap formed by the separator sword can be stabilized by sliding the separator wedge under the separator sword; the separator wedge firmly holds the lowermost sheet in the then forming auxiliary pile by suction at the trailing edge thereof, so that a suitable auxiliary pile carrier can then be thrust under the separator wedge through the gap, which has then become enlarged, for example, by the lowering of the main pile. Both rod-type rakes and auxiliary pile boards, such as so-called hurdle or cradle boards, are suitable as the auxiliary pile carrier. In a particular construction in accordance with the invention, it is contemplated that the auxiliary pile carrier, especially a hurdle or cradle board, moves transversely to sheet travel into the gap between two sheets formed by the separator sword and the separator wedge.

Other features which are considered as characteristic for the invention are set forth in the appended claims.

Although the invention is illustrated and described herein as embodied in a device for forming an auxiliary sheet pile during a nonstop pile change in a delivery of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

DESCRIPTION OF THE PREFERRED EMBODIMENTS

Figure 1:
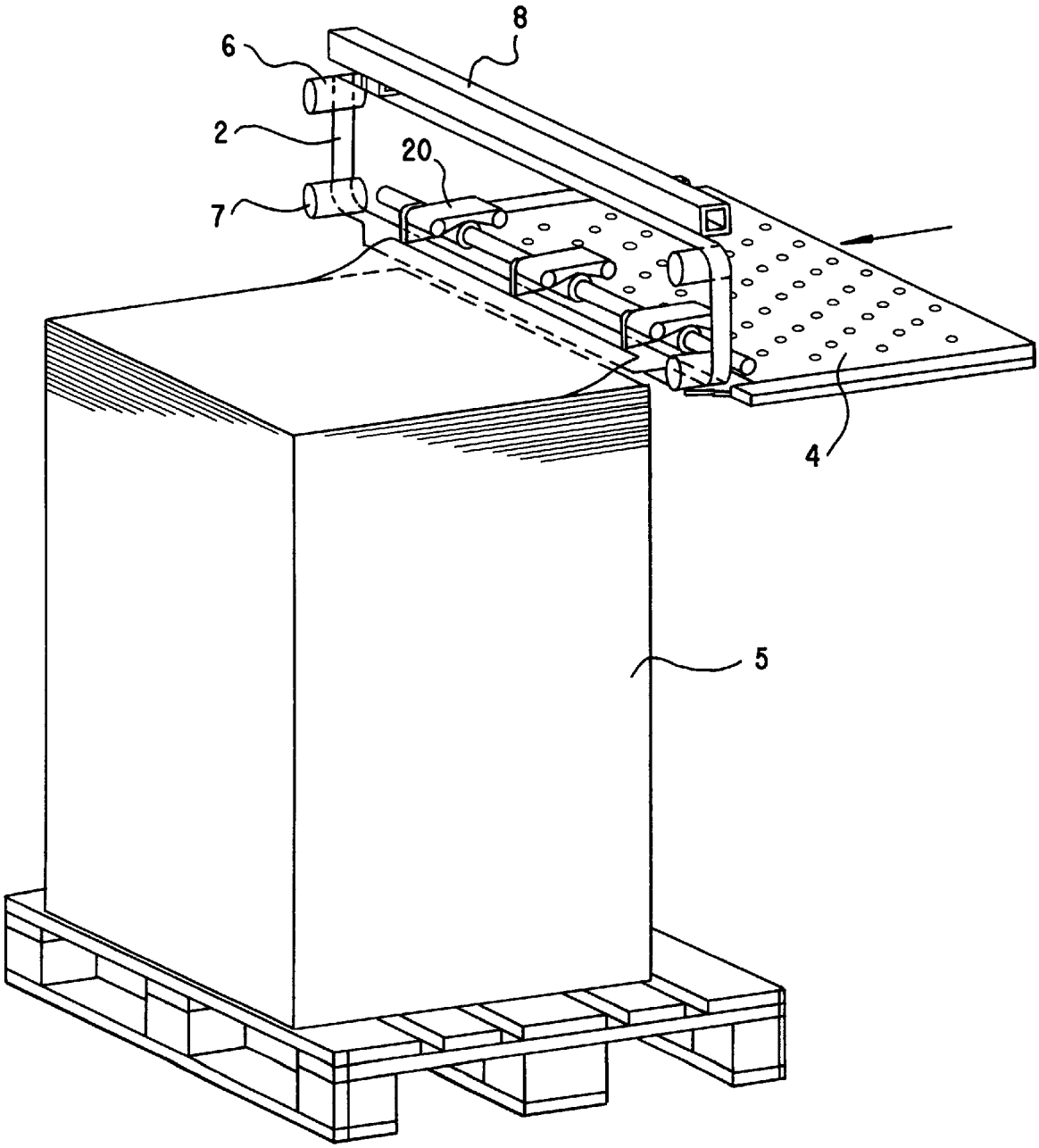
FIG. 1 is a perspective view of the device for forming an auxiliary sheet pile during a nonstop pile change in a delivery of a printing press in accordance with the invention.
Figure 2:
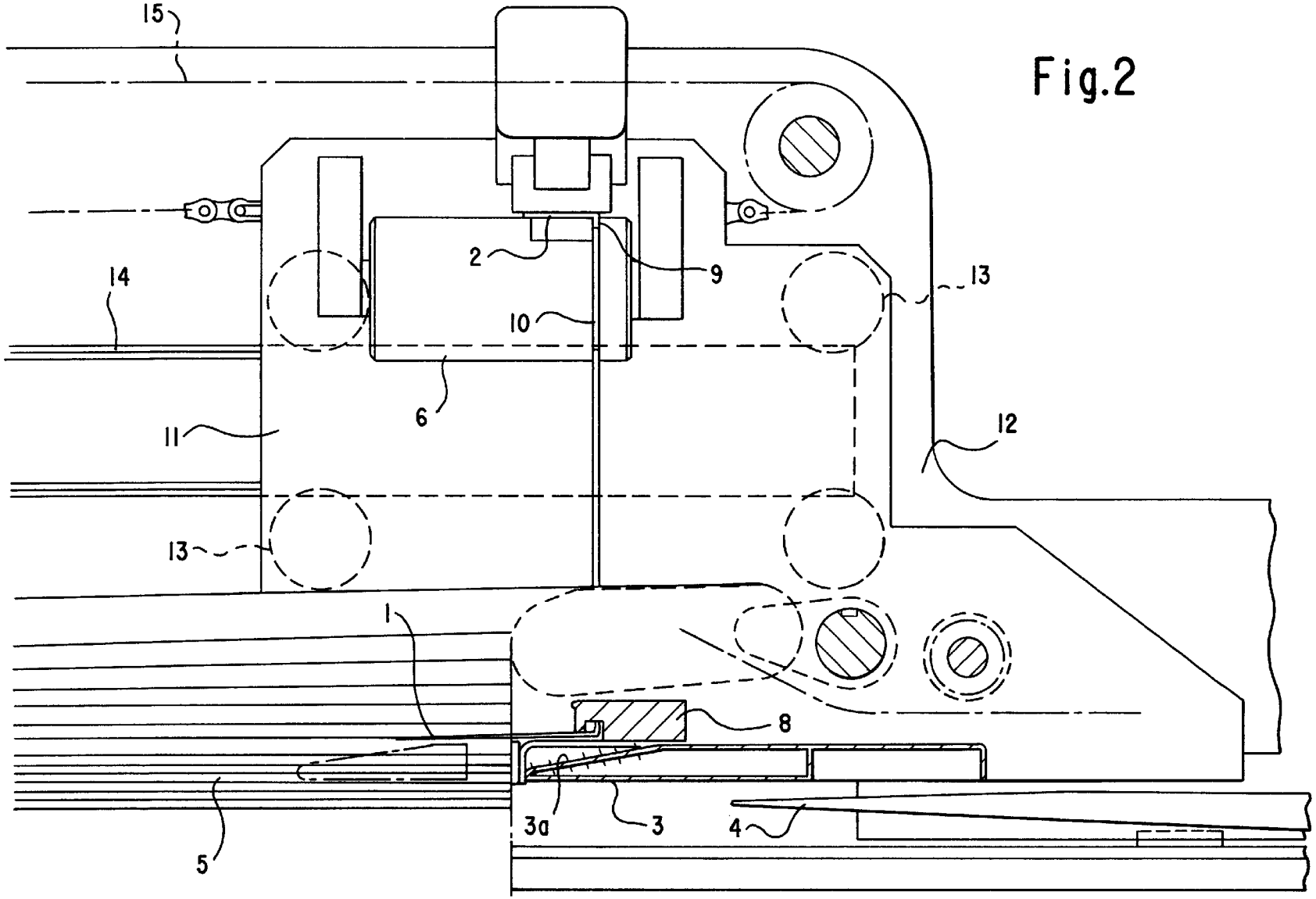
FIG. 2 is an enlarged fragmentary, approximately axial longitudinal sectional view of the device shown in FIG. 1.

Referring now to the drawing and, first, particularly to FIGS. 1 to 4 thereof, there is shown therein an exemplary embodiment of the device according to the invention wherein a separator sword 1 is provided on an endlessly revolving steel belt 2, and a separator wedge movably guided linearly in the sheet-feeding direction represented by the arrow in FIG. 1, is movable at a level below the separator sword 1. Below the separator wedge 3, a conventional auxiliary pile carrier 4, such as a rod-type rake, a so-called hurdle board or the like, is likewise movably guided linearly, so that the auxiliary pile carrier is insertable in the sheet-feeding direction into the gap formed between two sheets in the sheet pile 5 by the separator sword 1 cooperating with the separator wedge 3, and on-coming sheets are temporarily depositable in an auxiliary pile in a conventional manner, so as thereby to permit the main sheet pile to be changed.

The steel band 2 is guided in a gantry-like manner via two upper deflection rollers 6 and two lower deflection rollers 7, so that the sheet transport from the printing press to the sheet stack 5 through this so-called gantry is effected, for example, by endless conveyor chains with sheet gripper bars secured thereto, and the oncoming sheets are decelerated with the possible cooperation of braking belts 20 before the sheets are deposited on the sheet pile 5. Below the oncoming sheets, the steel belt 2 is guided horizontally parallel to the plane of the sheet by a transversely extending crossbar 8 in the region of maximum sheet width. The trailing edge of the endless steel belt 2, as viewed in the sheet-feeding direction, is formed with a beveled edge 9 which engages in a guiding groove 10 formed in the same vertical plane both in each of the two deflection rollers 6 and 7 and in the crossbar 8.

The separator wedge 3 is disposed beneath the crossbar 8 and can be displaced in the sheet-feeding direction. In cross section, the separator wedge 3 has a hollow box-like profile, the interior of which is connected to a suction source, preferably the suction system of the printing press. The upper side of the front region, in the insertion direction of the separator wedge 3, is beveled to a wedge-shaped point and is provided with suction openings 3*a*. The separator wedge 3 may extend continuously across the sheet width or may be made up of a plurality of parts disposed side by side and distributed across the sheet width.

For adjusting to paper size or format, the deflection rollers 6 and 7 guiding the steel belt are supported in a carriage 11 having side parts which are horizontally movably guided along side walls 12 of the frame of the printing press. The crossbar 8 connects the side parts of the carriage 11 which are joined together by further transverse beams 13. The separator wedge 3 is also horizontally movably guided in the sheet-feeding direction on the carriage 11 so that, together with the separator sword 1, an adjustment to paper size or format is effected. The carriage 11 horizontally movable in guides 14 of the side parts 12 of the printing-press frame is connected to a drive, such as a chain 15, for example, for effecting paper size or format adjustment.

For driving the belt 2, which is drivable transversely to the sheet-feeding direction, together with the separator sword 1 provided thereon, as well as the separator wedge 3 in the sheet-feeding direction, pneumatic drives formed of piston-cylinder units energizable by compressed air are provided. The pneumatic drive for the horizontal motion of the separator wedge 3 is shown diagrammatically in FIG. 3. The piston rod 16 of the cylinder 17 actuatable by compressed air is formed with teeth which mesh with a gear wheel 18 rotatably supported on the carriage 11, the teeth of the gear wheel 18, in turn, meshing with a rack 19 which is horizontally movably guided on the carriage 11 and secured to the separator wedge 3.

Figure 3:
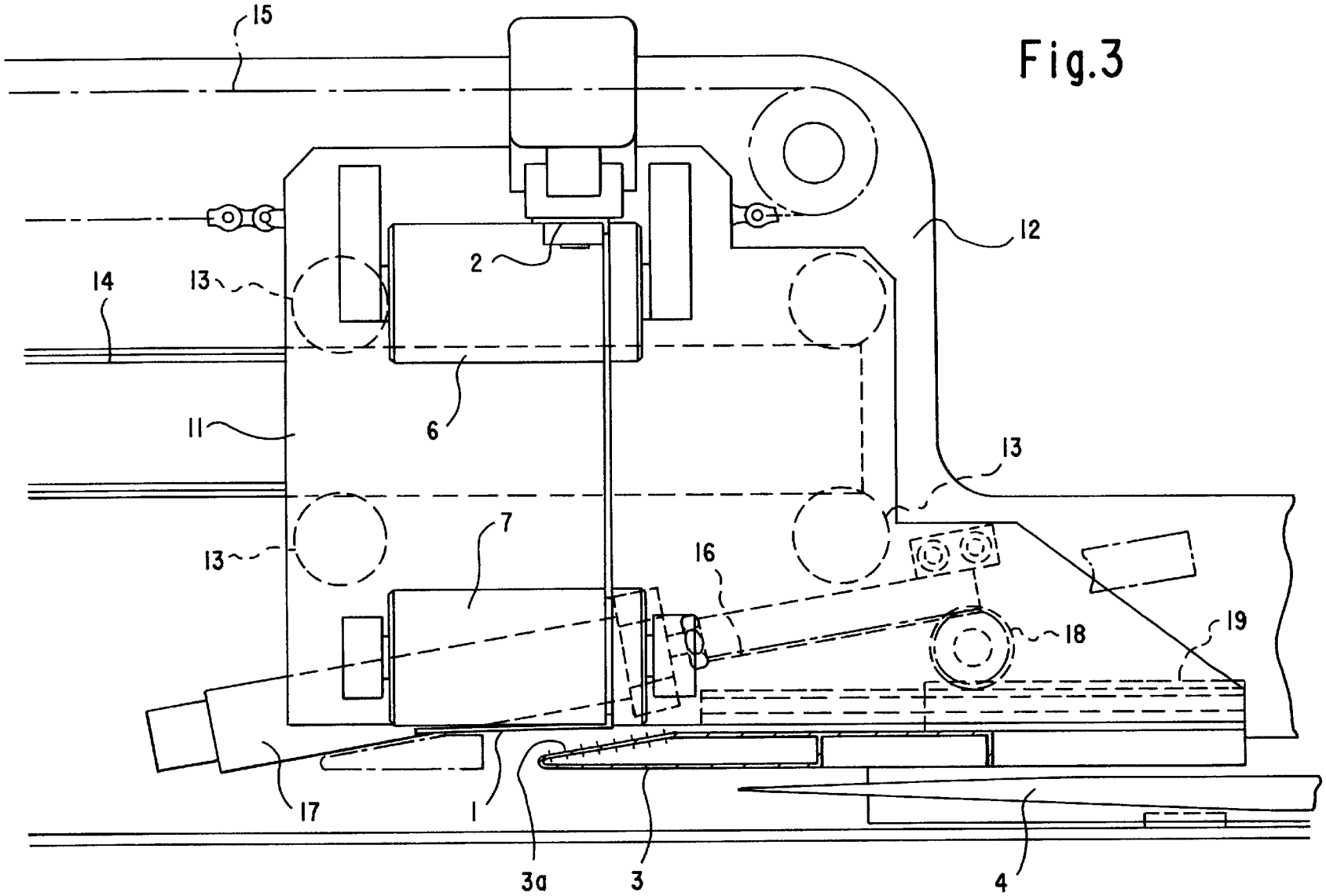
FIG. 3 is a view similar to that of FIG. 2 except that it is a longitudinal sectional view taken through a belt carrying a separator sword forming part of the device according to the invention.
Figure 4:
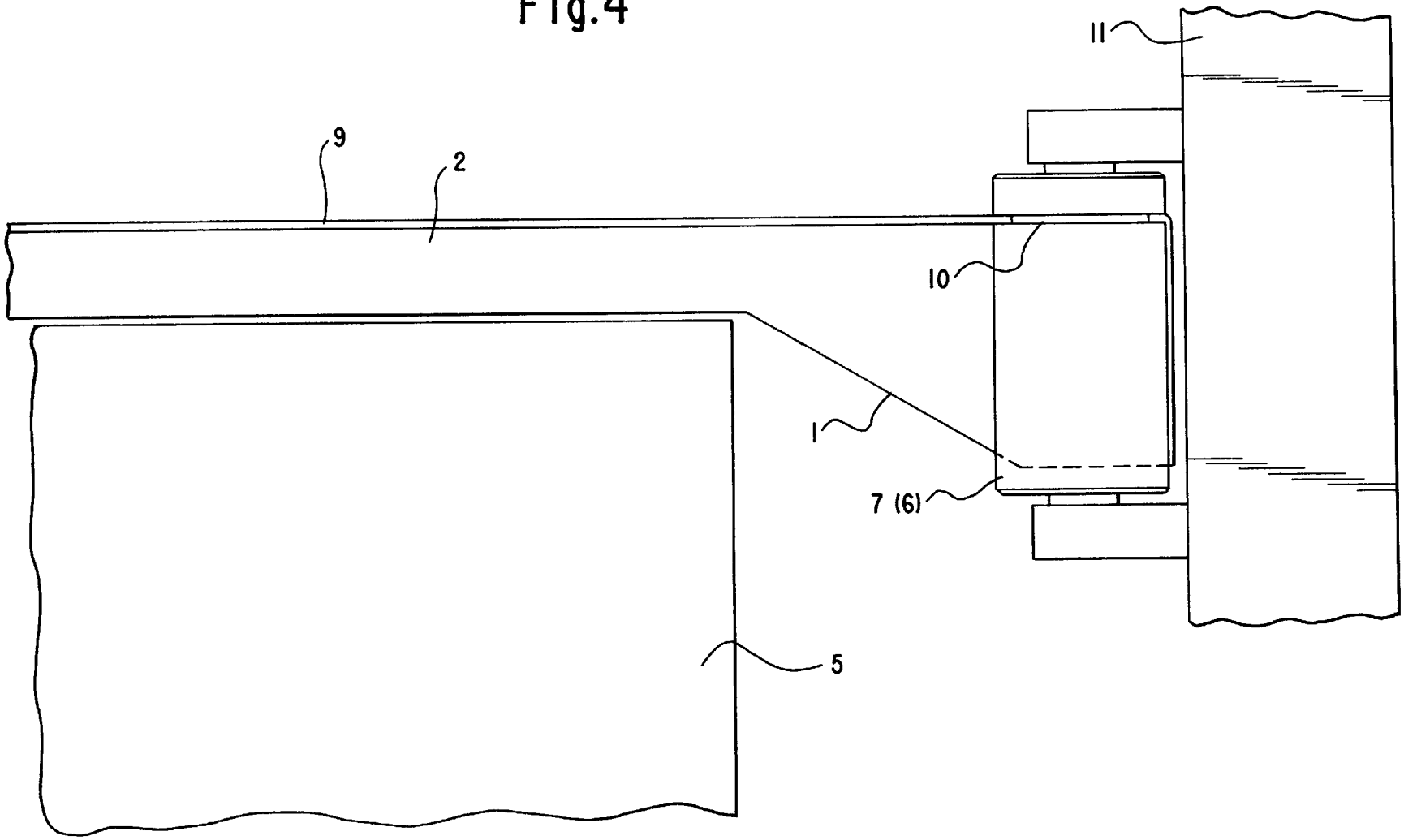
FIG. 4 is a slightly enlarged, fragmentary plan view of FIG. 3 showing the belt linearly guided over the sheet width together with the separator sword.

In FIG. 3, the unipartite construction of the separator sword 1 on the steel belt 2 is shown. The separator sword 1 is formed by a widening of the steel belt, extending obliquely to the sheet-feeding direction at an angle of approximately 45°, the length of this widening crosswise to the sheet-feeding direction being somewhat equivalent to the sheet width, preferably the maximum sheet width, so that the sheet to be supported in the trailing-edge region when the auxiliary pile is being formed is supported over the entire width thereof. In the rest position representing the starting position shown in FIG. 3, the separator sword 1 is located directly laterally adjacent the sheet pile 5, so that when a nonstop pile change is triggered, the separator sword 1 is moved inwardly by a preferably pneumatic drive, not shown in the drawing, with a kind of cutting motion at high speed from the side in between two sheets in the upper, loosened region of the sheet pile, and supports the pile, together with the sheets lying thereabove, briefly in the trailing-edge region in the sheet-feeding direction, so that in the thus-formed gap, the separator wedge 3 moves inwardly to beyond the leading edge of the separator sword 1 and firmly holds the thus-braced sheet by suction. The auxiliary pile carrier 4 is thrust, in a conventional manner, into the gap, which has been enlarged by the lowering of the main pile, and the separator sword 1 is retracted and moved by a revolving motion of the belt 2, respectively, out of the region of the sheet pile into the rest position shown in FIG. 3.

After the nonstop pile change has been initiated, in the illustrated exemplary embodiment, the separator sword 1 of the device according to the invention, adjusted to the sheet size or format, initially moves into the sheet pile and divides the sheet pile in the region of the trailing edge of the sheets. At the same time, non-illustrated stops for the trailing edge of the sheets are lowered, for example, pivoted away, and thereafter the separator wedge 3 enters underneath the separator sword 1 and applies suction to or aspirates the sheet, supported by the trailing edge thereof by the separator sword 1, likewise in the region of the trailing edge of the sheets. Thereafter, the separator sword 1 moves out of the region of the sheet pile and, simultaneously, the main pile is lowered. The auxiliary pile carrier moves into the thus-enlarged gap between the two sheets, so that the separator wedge 3 can also be retracted out of the region of the sheet pile, counter to the sheet-feeding direction. After the main pile has been changed, the auxiliary pile is lowered onto the main pile, so that the auxiliary pile carrier can return to the end position thereof shown in the drawing.

Figure 5:
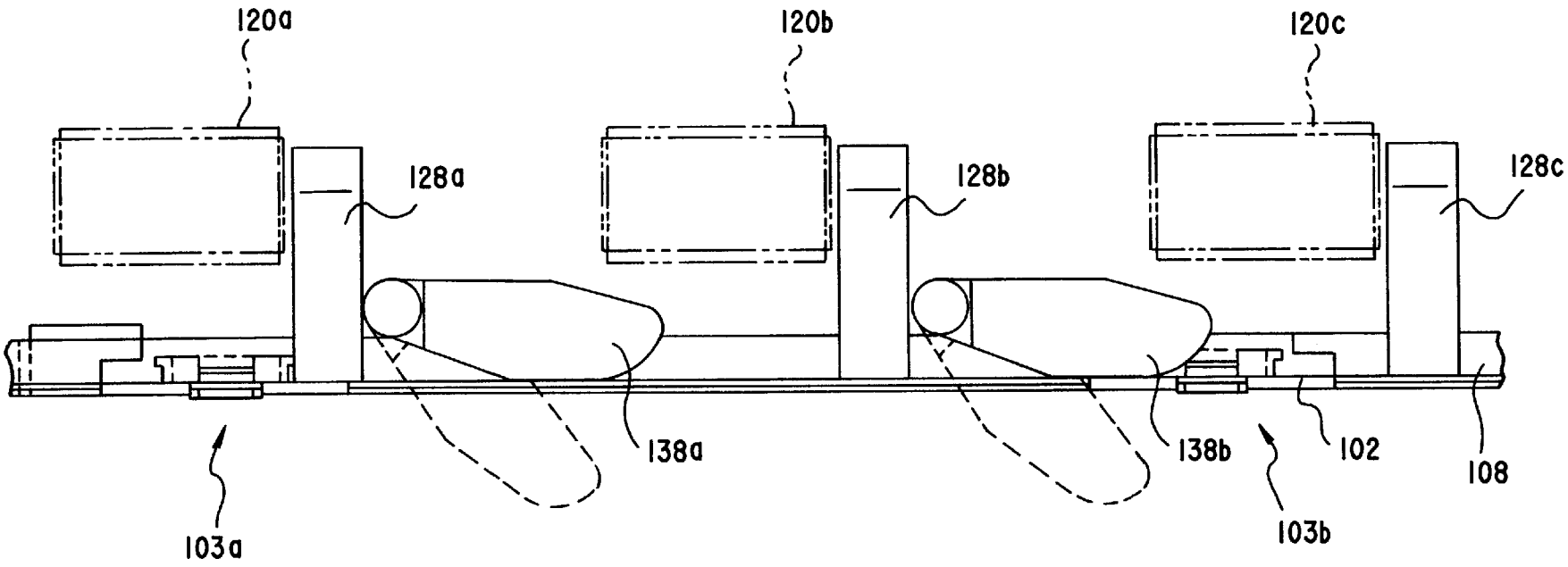
FIG. 5 is a fragmentary plan view of the sheet delivery showing another embodiment of a restraining or locking device forming part of the auxiliary sheet pile forming device according to the invention.
Figure 6:
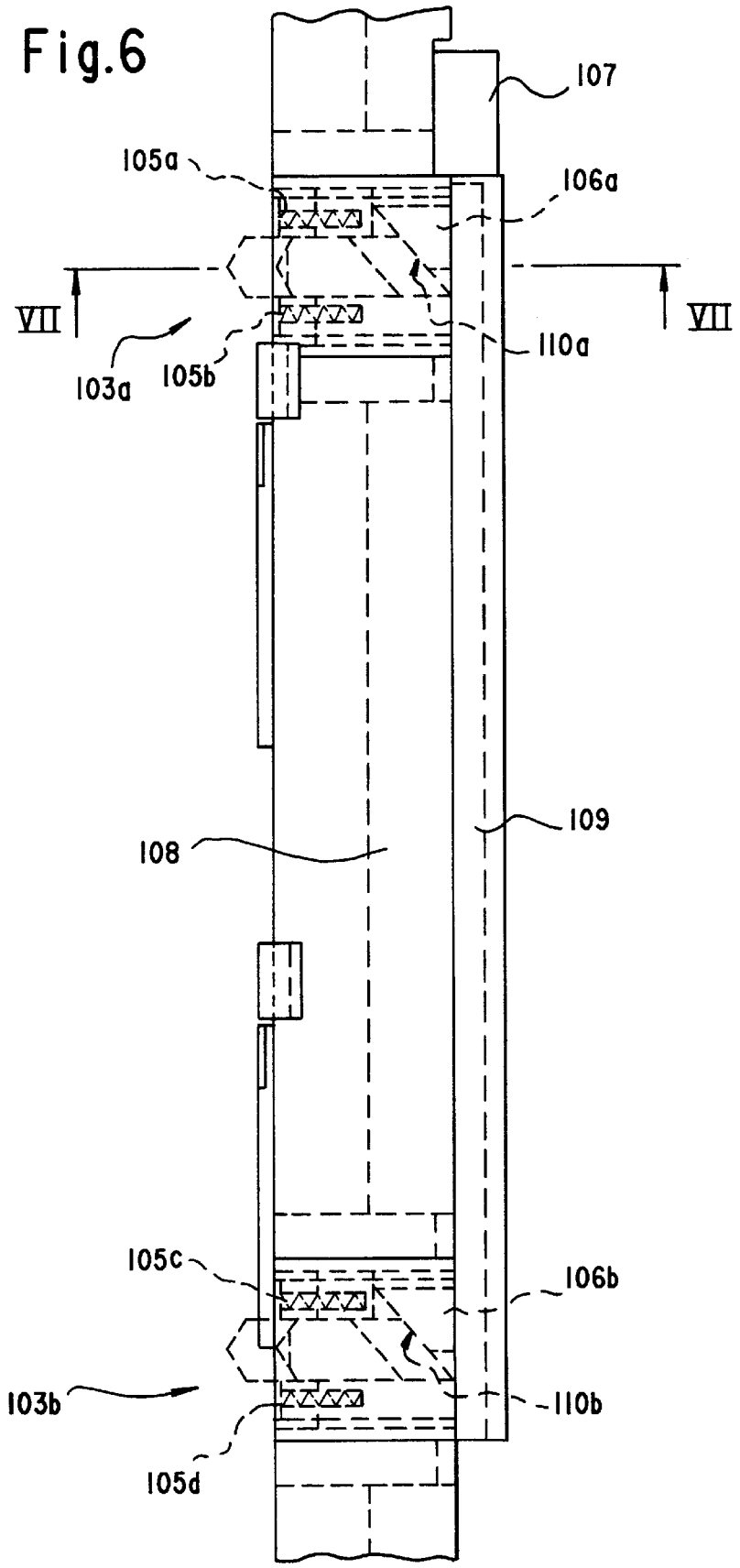
FIG. 6 is a top plan view of FIG. 5.
Figure 7:
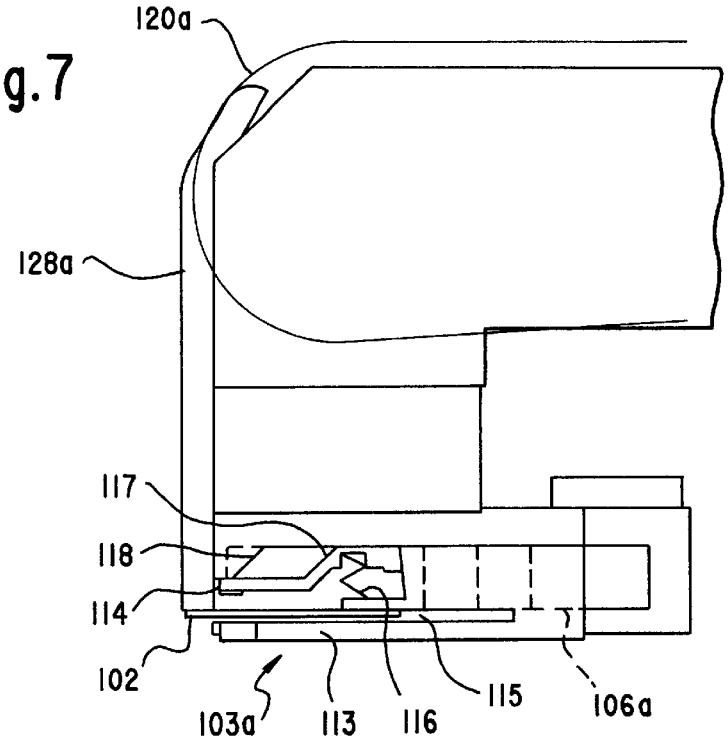
FIGS. 7 and 8 are enlarged cross-sectional views of FIG. 6 taken along the line VII—VII in the direction of the arrows and showing the device according to the invention in different operating phases thereof.

In the exemplary embodiment of FIGS. 5 to 7, instead of the movably guided separator wedge with suction nozzles, a different kind of restraining or locking device based on grippers is used. Reference numeral 108 indicates the crossbar of the sheet delivery whereon, via bearing blocks 128*a*, 128*b* and 128*c*, among other elements, the rollers via which three braking belts 120*a*, 120*b* and 120*c* are guided are rotatably supported. The sheets to be delivered are fed via these braking belts 120*a* to 120*c*.

Also secured to the crossbar 108 are two pivotal trailing-edge stops 138*a* and 138*b,* at which the trailing or rear edge of the sheet pile 5 (FIG. 1) aligns itself. Reference numeral 102 identifies the steel belt revolving in the lower region of the crossbar 108, and guiding the separator sword, not shown in FIG. 5. Gripper modules, which represent a restraining device, are disposed at the locations 103*a* and 103*b* in the crossbar 108, and serve to grip the trailing edge of the upper sheet resting on the separator sword and to firmly hold that trailing edge until such time as the auxiliary pile carrier has been inserted beneath the sheet.

From the plan view of FIG. 5, it is apparent that the grippers 103*a* and 103*b* can be moved out of the crossbar 108, counter to the force of two spring pairs 105*a* and 105*b,* and 105*c* and 105*d,* respectively, in a direction towards the trailing edge of the sheet to be grasped in order to grip the sheet and firmly hold it. To that end, a pneumatic cylinder 107 is disposed on the crossbar 108, and has a piston which is connected to an actuating rod 109. Two blocks 106*a* and 106*b,* which are provided with chamfers 110*a* and 110*b,* are secured to the rod 109 and, upon actuation of the rod 109, these blocks 106*a* and 106*b* cooperate with the likewise chamfered rear side of the grippers 103*a* and 103*b* and advance the grippers 103*a* and 103*b,* which are supported in a guide in the crossbar 108, in the sheet-feeding direction.

Figure 8:
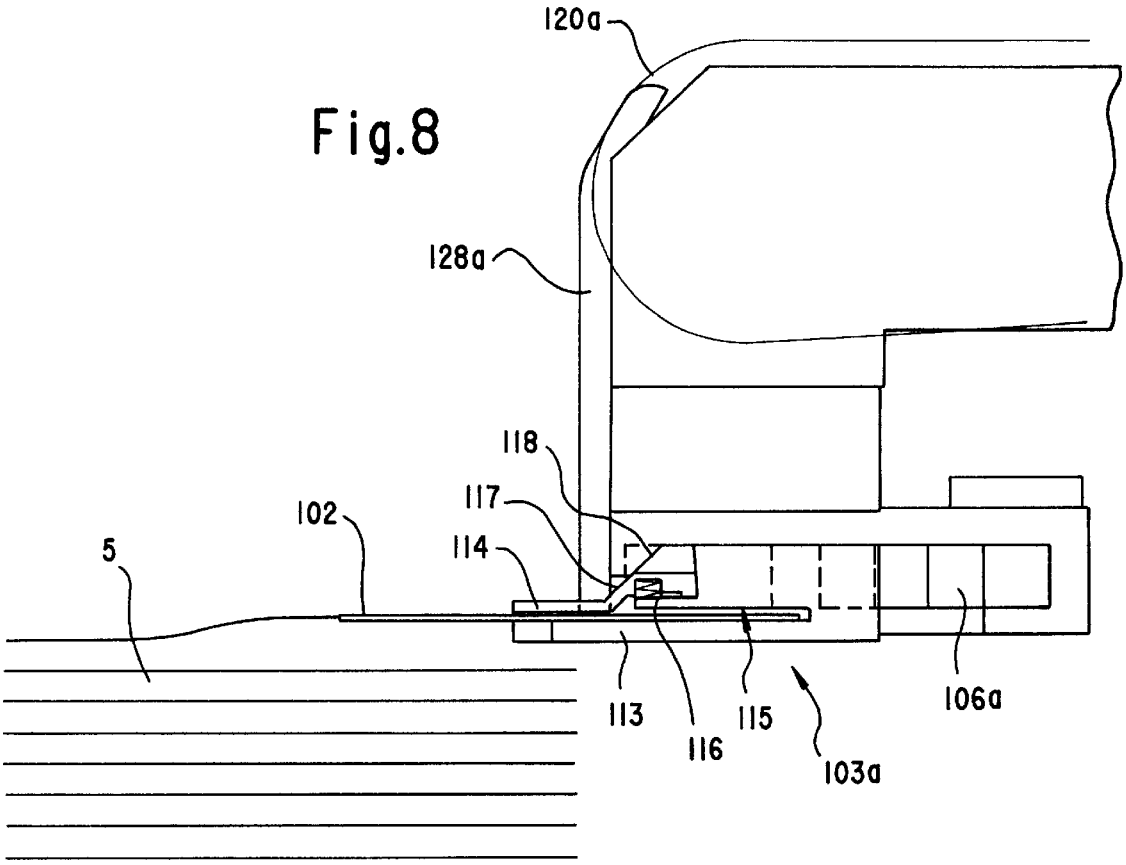

From the enlarged views of FIGS. 7 and 8 it is apparent how, based upon the aforedescribed motion, the jaws of the grippers can simultaneously be closed for firmly holding the applicable sheet. To that end, each of the two grippers 103*a* and 103*b* has two jaws, that is, one fixed jaw 113 and one movable jaw 114, kept open by a spring 116, on the top front end of the forklike gripper. The outside of the upper jaw 114 is also provided with a chamfer 117 and cooperates with a stop 118 in the crossbar 108 in such a manner that when the gripper jaw 114 runs up onto the stop 118 with its chamfer 117, it is pressed against the fixed jaw 113 counter to the force of the spring 116. Because the two jaws 113 and 114 of the gripper 103 enclose the steel belt 102, which runs in the groove 115, in the region of the separator sword, in the course of the closing motion they press the sheet resting on the separator sword against the separator sword and firmly hold it, until the auxiliary pile carrier, which is not shown in FIGS. 7 and 8, has been inserted entirely under the sheet. In this manner, the entering auxiliary pile carrier is prevented from displacing the sheet resting on the separator sword and damaging it.

When the auxiliary pile carrier has reached the position thereof, the grippers 103*a* and 103*b* move back into the rest position thereof and are opened in the course thereof, and the separating belt 102, with the separator sword secured thereto, moves laterally back into the rest position thereof as well, while, on the other hand, the trailing-edge stops 138*a* and 138*b* pivot away (FIG. 5) into the working position, that is, the position shown in broken lines in FIG. 6.

We claim:

1. Device for forming an auxiliary sheet pile during a nonstop pile change in a delivery of a printing press, comprising:

an auxiliary pile carrier for temporarily receiving oncoming sheets, said auxiliary pile carrier being insertable in a sheet feeding direction between two sheets separated from one another at respective trailing edges thereof;

a separator sword briefly supporting an upper one of the two sheets at a rear edge thereof over the entire width of the upper sheet, until said auxiliary pile carrier has reached an inserted position thereof; and a restraining device movable in the sheet feeding direction and firmly holding the upper sheet in a trailing edge region thereof, until said auxiliary pile carrier has been inserted, for securing the upper sheet against displacement by said auxiliary pile carrier.

2. Auxiliary pile forming device according to claim 1, wherein said restraining device is a separator wedge movable in the sheet feeding direction and being subjectible to suction, said separator wedge having suction nozzles on a top thereof and cooperating with the separator sword so that said separator wedge is slidable under the separator sword in the sheet feeding direction for firmly holding the upper sheet by suction in a trailing-edge region thereof, until the auxiliary pile carrier has been inserted.

3. Auxiliary pile forming device according to claim 2, wherein said separator wedge is formed with a cross section parallel to the sheet feeding direction which has a flat boxlike profile, said boxlike profile being beveled in the sheet feeding direction at a front top side thereof, said suction nozzles located in the beveled region and being connected via the interior of said boxlike profile to a source of suction.

4. Auxiliary pile forming device according to claim 3, wherein said suction source is the suction system of the printing press.

5. Auxiliary pile forming device according to claim 2, including a pneumatic piston-cylinder unit for driving the separator wedge.

6. Auxiliary pile forming device according to claim 1, including a carriage adjustably guidable in the sheet feeding direction, the separator sword being provided on a revolvingly drivable belt and supported therewith in said carriage.

7. Auxiliary pile forming device according to claim 6, wherein said belt is a flexible belt extending obliquely to the sheet feeding direction and the separator sword is formed by a widening of said flexible belt, the separator sword being coated with plastic material.

8. Auxiliary pile forming device according to claim 7, wherein said carriage is adjustable in accordance with a selected sheet format so as to allow said flexible belt with the separator sword formed thereon to support oncoming sheets of said selected sheet format.

9. Auxiliary pile forming device according to claim 7, including deflection rollers supported in said carriage for guiding said flexible belt with the separator sword formed thereon parallel to the plane of the lower one of the two sheets.

10. Auxiliary pile forming device according to claim 9, wherein said deflection rollers for guiding said revolvingly drivable flexible belt formed with the separator sword are formed with respective guiding grooves on the circumferences thereof, said flexible belt being formed so as to engage in said guiding grooves.

11. Auxiliary pile forming device according to claim 9, including a crossbar extending over the sheet width, said flexible belt being guidable at a trailing edge thereof, as viewed in the sheet feeding direction, parallel to the plane of the sheets, in said crossbar.

12. Auxiliary pile forming device according to claim 7, wherein said flexible belt is a steel belt.

13. Auxiliary pile forming device according to claim 7, wherein said plastic material is polytetrafluorethylene.

14. Auxiliary pile forming device according to claim 1, including trailing-edge stops for the sheets in the sheet pile, said stops being disposed so as to be lowerable and pivotable, respectively.

15. Auxiliary pile forming device according to claim 1, wherein said restraining device includes at least one gripper cooperating with the separator sword so that the gripper grasps the upper sheet at a trailing-edge region thereof and firmly holds it until the auxiliary pile carrier has been inserted.

16. Auxiliary pile forming device according to claim 15, wherein said at least one gripper is movable in the sheet feeding direction.

17. Auxiliary pile forming device according to claim 15, including a separator belt revolvably driven transversely to the sheet feeding direction and carrying said separator sword, said at least one gripper having open gripper jaws by which said gripper encloses one of said separator belt and said separator sword, and clamps the upper sheet against one of said separator belt and said separator sword.

18. Auxiliary pile forming device according to claim 17, wherein at least one of said jaws of said at least one gripper is kept open by spring force and is formed with a chamfer cooperating with a stop so that said at least one gripper jaw closes upon running onto said stop.

19. Device for forming an auxiliary sheet pile during a nonstop pile change in a delivery of a printing press, comprising:

an auxiliary pile carrier for temporarily receiving oncoming sheets, said auxiliary pile carrier insertable in a sheet feeding direction between two sheets separated from one another at respective trailing edges thereof;

a separator sword briefly supporting an upper one of the two sheets at a rear edge thereof over the entire width of the upper sheet, until said auxiliary pile carrier has reached an inserted position thereof;

a separator belt revolvably driven transversely to the sheet feeding direction and-carrying said separator sword;

a restraining device having at least one gripper cooperating with said separator sword, said at least one gripper grasping the upper sheet at a trailing-edge region thereof and firmly holding it, until said auxiliary pile carrier has been inserted, for securing the upper sheet against displacement by said auxiliary pile carrier, said at least one gripper having open gripper jaws by which said gripper encloses one of said separator belt and said separator sword, and clamps the upper sheet against one of said separator belt and said separator sword.

20. Auxiliary pile forming device according to claim 19, wherein at least one of said jaws of said at least one gripper is kept open by spring force and is formed with a chamfer cooperating with a stop so that said at least one gripper jaw closes upon running onto said stop.

* * * * *